US008817580B2

(12) United States Patent
Leoni et al.

(10) Patent No.: US 8,817,580 B2
(45) Date of Patent: Aug. 26, 2014

(54) FASTENING OF A DIAL TO A TIMEPIECE BOTTOM PLATE

(71) Applicant: ETA SA Manufacture Horlogere Suisse, Grenchen (CH)

(72) Inventors: Stephane Leoni, Courtelary (CH); Thierry Altenhoven, Delemont (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 0 days.

(21) Appl. No.: 13/946,382

(22) Filed: Jul. 19, 2013

(65) Prior Publication Data

US 2014/0029393 A1 Jan. 30, 2014

(30) Foreign Application Priority Data

Jul. 26, 2012 (EP) ..... 12178027

(51) Int. Cl.
*G04B 19/06* (2006.01)

(52) U.S. Cl.
USPC ..... 368/236

(58) Field of Classification Search
CPC .... G04B 19/14; G04B 19/06; G04B 37/0409; G04B 19/065; G04B 19/28
USPC ..... 368/236, 300, 308, 205, 223, 228, 232, 368/239, 243, 287, 294, 295, 297, 299
See application file for complete search history.

(56) References Cited

U.S. PATENT DOCUMENTS

| | | | | |
|---|---|---|---|---|
| 543,628 | A | 7/1895 | Marsh | |
| 4,207,735 | A * | 6/1980 | Ishigaki et al. | 368/300 |
| 6,456,569 | B1 * | 9/2002 | Stauffer | 368/236 |
| 6,575,619 | B1 * | 6/2003 | Stauffer | 368/299 |

FOREIGN PATENT DOCUMENTS

| | | |
|---|---|---|
| CH | 82 809 | 10/1919 |
| CH | 120 846 | 6/1927 |
| CH | 125 760 | 5/1928 |
| DE | 296 07 040 U1 | 7/1996 |

OTHER PUBLICATIONS

European Search Report issued Dec. 14, 2012 in EP 12178027, filed Jul. 26, 2012 ( with English Translation).

* cited by examiner

*Primary Examiner* — Edwin A. Leon
(74) *Attorney, Agent, or Firm* — Oblon, Spivak, McClelland, Maier & Neustadt, L.L.P.

(57) ABSTRACT

A timepiece assembly including centring pins integral with a bottom plate, each arranged to cooperate with radial and tangential play with an oblong groove in a dial, for the relative positioning of the dial with respect to the bottom plate, and a holding means integral with the bottom plate, arranged to cooperate with a complementary holding device integral with the dial, the holding device and/or complementary holding device including an elastic return device for pressing the dial resting onto the bottom plate. The elastic return device has tangential mobility in a plane perpendicular to the plane of the bottom plate and to a radial line connecting the center of the bottom plate to the elastic return device.

9 Claims, 1 Drawing Sheet

E-E 100
1000
PT
JT
JT1
JR1
R
O
P

FASTENING OF A DIAL TO A TIMEPIECE BOTTOM PLATE

This application claims priority from European Patent Application No. 12178027.4 filed Jul. 26, 2012, the entire disclosure of which is incorporated herein by reference.

FIELD OF THE INVENTION

The invention concerns a timepiece assembly comprising at least one bottom plate and at least one dial arranged to be secured one on top of the other, comprising a plurality of centring pins integral with said bottom plate, respectively with said dial, each arranged to cooperate, with radial and tangential play, with an oblong groove in said dial, respectively in said bottom plate, for the relative positioning of said at least one dial relative to said at least one bottom plate, said assembly further comprising a holding means integral with said bottom plate, respectively with said dial, arranged to cooperate with a complementary holding means integral with said dial, respectively with said bottom plate, said holding means and/or complementary holding means comprising a means of elastic return for pressing said at least one dial resting onto said at least one bottom plate, wherein said elastic return means has substantially tangential mobility in a plane perpendicular to the plane of said bottom plate and to a radial line connecting the centre of said bottom plate to said elastic return means.

The invention also concerns a timepiece including at least one such timepiece assembly.

The invention concerns the field of horology, and more specifically the field of assembling dials onto the bottom plates of watches.

BACKGROUND OF THE INVENTION

When a bottom plate and a watch dial are made of different materials, they are subject to differential expansion, because of the different expansion coefficients of their materials. Consequently, a dial secured to a bottom plate, and of generally much smaller thickness than that of the bottom plate, may bow or retract with variations in temperature. In some critical cases, particularly at high temperatures, for example in tropical or desert areas, this type of deformation may cause the hands to come out, which makes the watch unsuitable for use.

CH Patent Application No 120 846 A, in the name of BOVET FRERES, discloses the securing of a dial onto a bottom plate using clips cooperating with pins. U.S. Patent Application No. 543 628A, in the name of MARSH, discloses a similar device.

CH Patent Application No. 82 809 A, in the name of WILLIAMSON, discloses a device for securing a dial with feet by clamping the dial feet, housed in a cavity of a slot in a stamped bottom plate, by angularly folding radial fingers comprised in said bottom plate.

CH Patent Application No. 125 760, in the name of GAERTNER, discloses the securing of a dial with feet by elastic retention of the feet using spring flanges held by screws.

SUMMARY OF THE INVENTION

The invention proposes to ensure the retention of the dial and its geometry (in general the flatness thereof) despite the different expansion of its components.

The invention also proposes to provide a simple method of securing the dial to the bottom plate, without pre-machining the dial, in particular at the periphery thereof.

The invention therefore concerns a timepiece assembly comprising at least one bottom plate and at least one dial arranged to be secured one on top of the other, comprising a plurality of centring pins integral with said bottom plate, respectively with said dial, each arranged to cooperate, with radial and tangential play, with an oblong groove in said dial, respectively in said bottom plate, for the relative positioning of said at least one dial relative to said at least one bottom plate, said assembly further comprising a holding means integral with said bottom plate, respectively with said dial, arranged to cooperate with a complementary holding means integral with said dial, respectively with said bottom plate, said holding means and/or said complementary holding means comprising an elastic return means for pressing said at least one dial resting onto said at least one bottom plate, wherein said elastic return means has substantially tangential mobility along a plane perpendicular to the plane of said bottom plate and to a radial line connecting the centre of said bottom plate to said elastic return means, characterized in that said holding means and/or said complementary holding means carrying said elastic return means includes at least one elastic clip lug, which juts out in a cantilever manner relative to said dial or respectively to said bottom plate in a substantially perpendicular direction to the plane of said dial or of said bottom plate, said lug comprising a head with a return stop surface for cooperating in abutment with a complementary stop surface comprised in said bottom plate or respectively in said dial.

The invention also concerns a timepiece including at least one such timepiece assembly.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figures 1, 2, 3, 4, 5, 6, 7, 8:
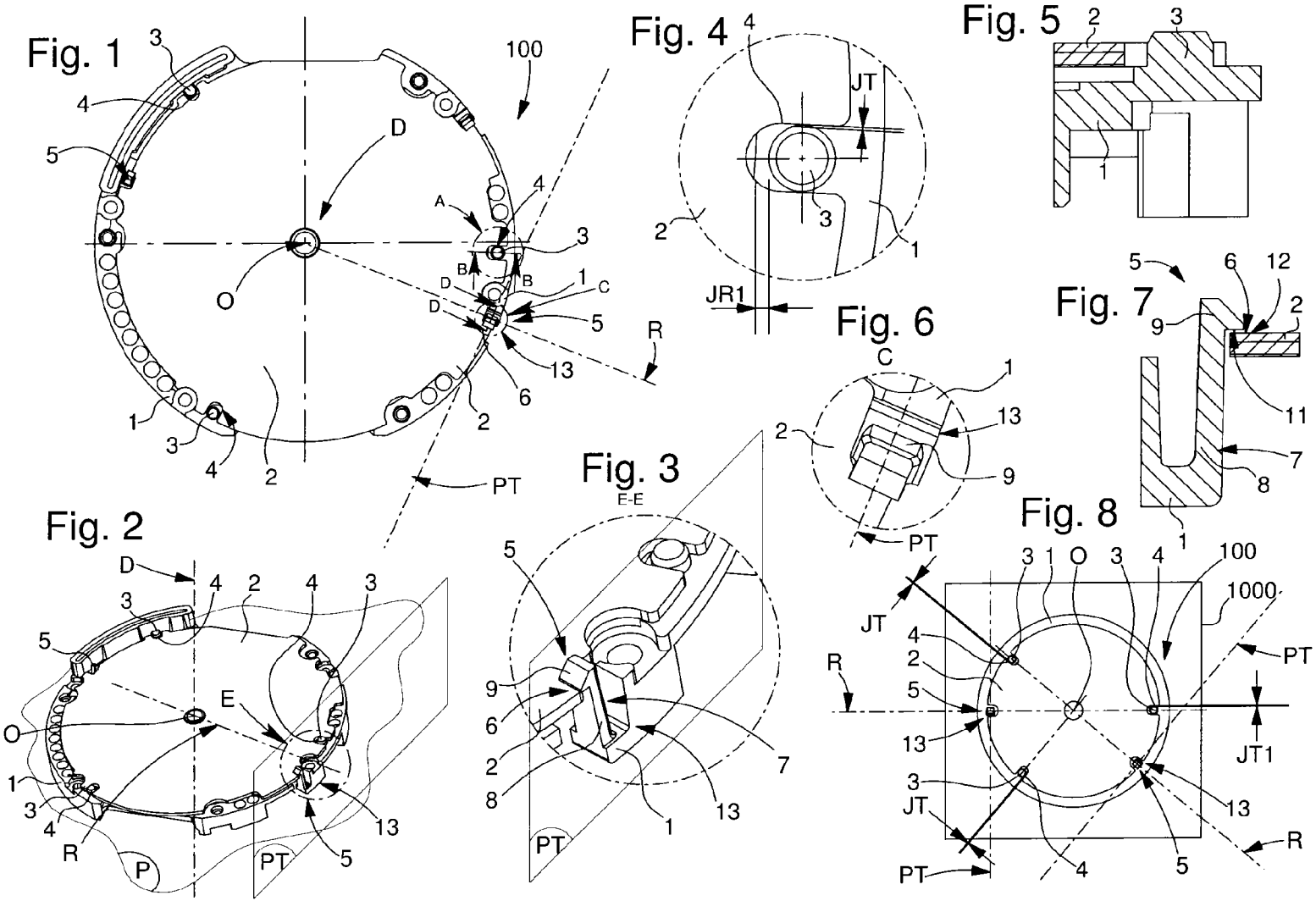
FIG. 1 shows a schematic, plan view of a timepiece assembly according to the invention, with a bottom plate on which a dial is mounted, said dial is centred by centring pins and is held pressed onto said bottom plate by an elastic return means with tangential play.
FIG. 2 shows a schematic, perspective view of the assembly of FIG. 1.
FIG. 3 shows a schematic, perspective view of a detail of an elastic return means for pressing said assembly, shown at reference E in FIG. 2.
FIG. 4 shows a schematic plan view of a detail of the positioning of a centring pin in an oblong groove, shown at reference A in FIG. 1.
FIG. 5 shows a schematic cross-section, in a plane perpendicular to the plane of the bottom plate, of a detail of the positioning of a centring pin in an oblong groove, shown at reference BB in FIG. 1.
FIG. 6 shows a schematic, plan view of a detail of the cooperation between an elastic return means pressing together said assembly, positioned in a radial groove, and a bearing surface of the dial, shown at reference C in FIG. 1.
FIG. 7 shows a schematic cross-section, in a plane tangential to the bottom plate, of a detail of the cooperation between an elastic return means pressing together said assembly, positioned in a radial groove, and a bearing surface of the dial, shown at reference DD in FIG. 1.
FIG. 8 shows block diagrams of a timepiece including a timepiece assembly according to the invention.

The invention concerns the field of horology, and more specifically the field of assembling dials onto the bottom plates of watches.

The invention more particularly concerns a timepiece assembly 100, which includes:

at least one bottom plate 1;

and at least one dial 2, arranged to be secured one on top of the other;

a plurality of centring pins 3 integral with bottom plate 1, respectively with dial 2, each arranged to cooperate with radial and tangential play with an oblong groove 4 in dial 2, respectively in bottom plate 1, for the relative positioning of at least one dial 2 relative to the at least one bottom plate 1.

This assembly 100 further includes a holding means 5, which is integral with bottom plate 1, respectively with dial 2, and which is arranged to cooperate with a complementary holding means 6. This means 6 is integral with dial 2, respectively with bottom plate 1.

Holding means 5 and/or complementary holding means 6 includes an elastic return means 7, for pressing the at least one dial 2 resting onto the at least one bottom plate 1.

According to the invention, and as seen in FIGS. 1, 2, 3, 6 and 8, elastic return means 7 has substantially tangential mobility in a plane PT, which is perpendicular both to plane P of bottom plate 2 and to a radial line R which connects the centre O of bottom plate 2 to elastic return means 7.

This tangential mobility means that deformations of dial 2, respectively of bottom plate 1, are able to occur due to thermal stresses.

The invention is more particularly illustrated for the case where pins 3 and holding means 5 are integral with bottom plate 1. Those skilled in the art will know how to form the reverse configuration where these elements are integral with dial 2, and also mixed configurations where, either pins 3 are integral with bottom plate 1 and holding means 5 is integral with dial 2, or where pins 3 are integral with dial 2 and holding means 5 is integral with bottom plate 1.

Preferably, as seen in FIGS. 1, 4 and 8, oblong grooves 4 are oriented substantially radially relative to an axis D positioned substantially at the centre O of bottom plate 1 and perpendicular to the plane P of bottom plate 1. Thus, dial 2 can expand and contract radially on bottom plate 1, while still being oriented by pins 3 in oblong grooves 4 and while being axially retained by holding means 5, advantageously formed by clips.

Advantageously, several pins 3 are used for orientating the dial. Preferably, one of pins 3 is used for centring the dial position, and the others are designed with a broader shake with their respective grooves 4 to provide guidance.

Preferably, for a first pin 3 used for centring, first tangential play JT1, between said first centring pin 3 and a first oblong groove 4 associated therewith, is less than the tangential play JT between each of the other centring pins 3 and the associated oblong groove 4.

Groove 4 of the first centring pin may also be reduced to a simple bore, in which case the first pin 3 serves as a pivot for dial 2 relative to bottom plate 1.

However, in a particular embodiment illustrated by the Figures, at least one said oblong groove 4 is an open, through groove, and preferably all the oblong grooves 4 are open, through grooves, to allow deformation of the dial during thermal expansion.

Preferably, the radial play JR1 between said first centring pin 3 and the first oblong groove 4 associated therewith is greater than or equal to the maximum radial thermal play between bottom plate 1 and dial 2.

In the embodiment illustrated in the Figures, holding means 5 is made in the form of clip lugs or clips. Thus, holding means 5 and/or complementary holding means 6 carrying elastic return means 7 includes at least one elastic clip lug 8, jutting out in a cantilever manner relative to dial 2, or respectively to bottom plate 1, in a substantially perpendicular direction to the plane of dial 2 or respectively of bottom plate 1.

Lug 8 has a head 9 with a return stop surface 11, which is arranged to cooperate in abutment with a complementary stop surface 12 comprised in bottom plate 1 or respectively in dial 2.

Preferably, each lug 8 is moveable in a notch 13 substantially radial to bottom plate 1 or respectively to dial 3, with a radial play at least equal to the maximum thermal play between bottom plate 1 and dial 2.

In a particular embodiment, as seen in the Figures, at least one said radial notch 13 is an open, through notch.

Advantageously, dial 2 is a cut blank dial.

The invention also concerns a timepiece 1000 including at least one such timepiece assembly 100.

The invention ensures the proper retention of the dial on the bottom plate regardless of the operating temperature of the watch. The differential expansion of the dial and the bottom plate is thus no longer critical.

The invention also reduces the manufacturing costs of the dial, which does not need to be injected or pre-machined but which may be used immediately after cutting, for example in the form of a cut sheet.

The components are simple and inexpensive to assemble, since a clipping system does not require any particular equipment.

The method of holding the dial on the bottom plate means that the pre-assembled assembly can be turned over during the watch manufacturing phases, due to the secure hold provided by the elastic retaining lugs.

The assembly time is short, due to the absence of screws, adhesive or suchlike.

What is claimed is:

1. A timepiece assembly comprising at least one bottom plate and at least one dial arranged to be secured one on top of the other, comprising a plurality of centring pins integral with said bottom plate, respectively with said dial, each arranged to cooperate with an oblong groove in said dial, respectively in said bottom plate, for the relative positioning of said at least one dial relative to said at least one bottom plate, said assembly further comprising a holding means integral with said bottom plate, respectively with said dial, arranged to cooperate with a complementary holding means integral with said dial, respectively with said bottom plate, said holding means and/or said complementary holding means comprising an elastic return means for pressing said at least one dial resting onto said at least one bottom plate, wherein said elastic return means has substantially tangential mobility along a plane perpendicular to the plane of said bottom plate and to a radial line connecting the centre of said bottom plate to said elastic return means, wherein said holding means and/or said complementary holding means carrying said elastic return means includes at least one elastic clip lug, which juts in a cantilever manner out relative to said dial or respectively to said bottom plate in a substantially perpendicular direction to the plane of said dial or of said bottom plate, said lug comprising a head with a return stop surface for cooperating in abutment with a complementary stop surface comprised in said bottom plate or respectively in said dial.

2. The timepiece assembly according to claim 1, wherein said oblong grooves are oriented substantially radially to an axis positioned substantially at the centre of said bottom plate and perpendicular to said plane of said bottom plate.

3. The timepiece assembly according to claim 1, wherein a first tangential play, between a first said centring pin and a first said oblong groove which is associated therewith, is less than the tangential play between each of the other said centring pins and said oblong groove associated therewith.

4. The timepiece assembly according to claim 1, wherein the radial play between a first said centring pin and a first said oblong groove associated therewith, is greater than or equal to the maximum radial thermal play between said bottom plate and said dial.

5. The timepiece assembly according to claim 1, wherein at least one said oblong groove is a through groove.

6. The timepiece assembly according to claim 1, wherein each said lug is moveable in a notch substantially radial to said bottom plate or respectively to said dial, with radial play at least equal to the maximum thermal play between said bottom plate and said dial.

7. The timepiece assembly according to claim 6, wherein said at least one said radial notch is a through notch.

8. The timepiece assembly according to claim 1, wherein said dial is a cut blank dial.

9. The timepiece including at least one timepiece assembly according to claim 1.

* * * * *